US006641332B1

(12) United States Patent
Alvarado

(10) Patent No.: US 6,641,332 B1
(45) Date of Patent: Nov. 4, 2003

(54) FOUNDATION SUPPORT AND PROCESS FOR STRUCTURES

(75) Inventor: Robert D. Alvarado, Ada, OK (US)

(73) Assignee: Appalachian Structural Systems, Inc., Cherokee, NC (US)

( * ) Notice: Subject to any disclaimer, the term of this patent is extended or adjusted under 35 U.S.C. 154(b) by 0 days.

(21) Appl. No.: 10/192,425

(22) Filed: Jul. 10, 2002

(51) Int. Cl.[7] ..... E02D 7/00; E02D 13/00; E02D 5/74

(52) U.S. Cl. ..... 405/232; 405/228; 405/230; 405/231; 405/244; 405/251; 52/155; 52/157; 52/169.13; 175/323; 175/389; 175/394

(58) Field of Search ..... 405/222, 228, 405/230, 231, 232, 244–247, 249, 251, 252.1, 253, 255, 259.1; 52/155, 156, 157, 169.13, 705, 707; 175/323, 386–389, 394, 406, 19, 21, 321; 248/156

(56) References Cited

U.S. PATENT DOCUMENTS

| | | | | | |
|---|---|---|---|---|---|
| 108,814 | A | | 11/1870 | Moseley | |
| 1,639,731 | A | | 8/1927 | Humiston | |
| 2,203,881 | A | * | 6/1940 | Schwab et al. | 405/263 |
| 3,054,285 | A | | 9/1962 | Roosen | |
| 3,651,876 | A | * | 3/1972 | Henson | 175/323 |
| 3,690,109 | A | * | 9/1972 | Lee | 405/241 |
| 3,794,127 | A | * | 2/1974 | Davis | 175/323 |
| 3,833,071 | A | * | 9/1974 | Koosman et al. | 175/323 |
| 3,846,991 | A | | 11/1974 | Wisotsky | |
| 3,992,890 | A | | 11/1976 | Pryke | |
| 4,405,115 | A | | 9/1983 | Boyadjieff | |
| 4,621,950 | A | * | 11/1986 | Kinnan | 405/231 |
| 4,673,315 | A | | 6/1987 | Shaw et al. | |
| 4,974,997 | A | | 12/1990 | Sero et al. | |
| 5,253,958 | A | | 10/1993 | Bellemare | |
| 5,482,407 | A | * | 1/1996 | Raaf | 405/230 |
| 5,560,739 | A | * | 10/1996 | Kunito | 405/232 |
| 5,919,005 | A | * | 7/1999 | Rupiper | 405/244 |
| 5,934,836 | A | * | 8/1999 | Rupiper et al. | 405/244 |
| 5,951,206 | A | * | 9/1999 | Gregory | 405/230 |
| 6,193,443 | B1 | * | 2/2001 | Trudeau et al. | 405/252 |
| 6,468,002 | B1 | * | 10/2002 | Gregory et al. | 405/230 |

FOREIGN PATENT DOCUMENTS

| | | | | |
|---|---|---|---|---|
| JP | 58222212 | * | 12/1983 | 405/245 |

* cited by examiner

*Primary Examiner*—Jong-Suk (James) Lee
(74) *Attorney, Agent, or Firm*—Arthur F. Zobal; Geoffrey A. Mantooth

(57) ABSTRACT

An elongated pilot member is forced into the ground and an auger with a hollow stem is positioned around the pilot member and rotated to move the auger into the ground. A second elongated member is coupled to the pilot member and an upward force is applied to the auger stem or to an extension thereof to enable a downward force to be applied to the second elongated member to force the second elongated member and the pilot member into the ground. The second elongated member and the auger stem then are attached together and to a foundation support member for providing support for a foundation.

8 Claims, 9 Drawing Sheets

FOUNDATION SUPPORT AND PROCESS FOR STRUCTURES

BACKGROUND OF THE INVENTION

1. Field of the Invention

The invention relates to a process and means for providing support for buildings.

2. Description of the Prior Art

Structures such as homes or commercial buildings many times are built on loose soil. In order to properly support these structures, the foundation must be adequately supported. Commercial buildings are supported by large and deep concrete piers formed in holes that extend from the surface downward to compacted soil. Such foundation supports are very heavy and costly and cannot be afforded by the average home owner.

SUMMARY OF THE INVENTION

It is an object of the invention to provide a new and useful process and system for providing support for a building which process is inexpensive and adds very little weight to the support system.

In accordance with the invention, an auger with a hollow stem is inserted into the ground and used as an anchor to aide in forcing an elongated member through the stem into the ground for use for support purposes.

In carrying out the process an elongated pilot member is forced into the ground and the auger stem is positioned around the pilot member and rotated to locate the auger in a fixed position in the ground. A second elongated member is coupled to the pilot member and an upward force is applied to the auger stem to enable a downward force to be applied to second elongated member to force the second elongated member and the pilot member into the ground additional elongated members are applied until a desired resistance is achieved. The elongated member and the auger stem then are attached together and to a foundation support member for providing support for the foundation.

Pressure measurements of the downward force applied are carried out to achieve the desired support for the foundation.

If deeper positioning of the hollow stem auger is desired, a tubular extension is coupled to the upper end of the auger stem and rotated to rotate the extension, the auger and pilot member further into the ground and the extension is used as an anchor to force the elongated members into the ground.

BRIEF DESCRIPTION OF THE DRAWINGS

FIG. 2 illustrates an initial step in the process wherein a power unit attached to the boom of the tractor is used to push a pilot tube into the ground.

DESCRIPTION OF THE PREFERRED EMBODIMENTS

Figure 1:
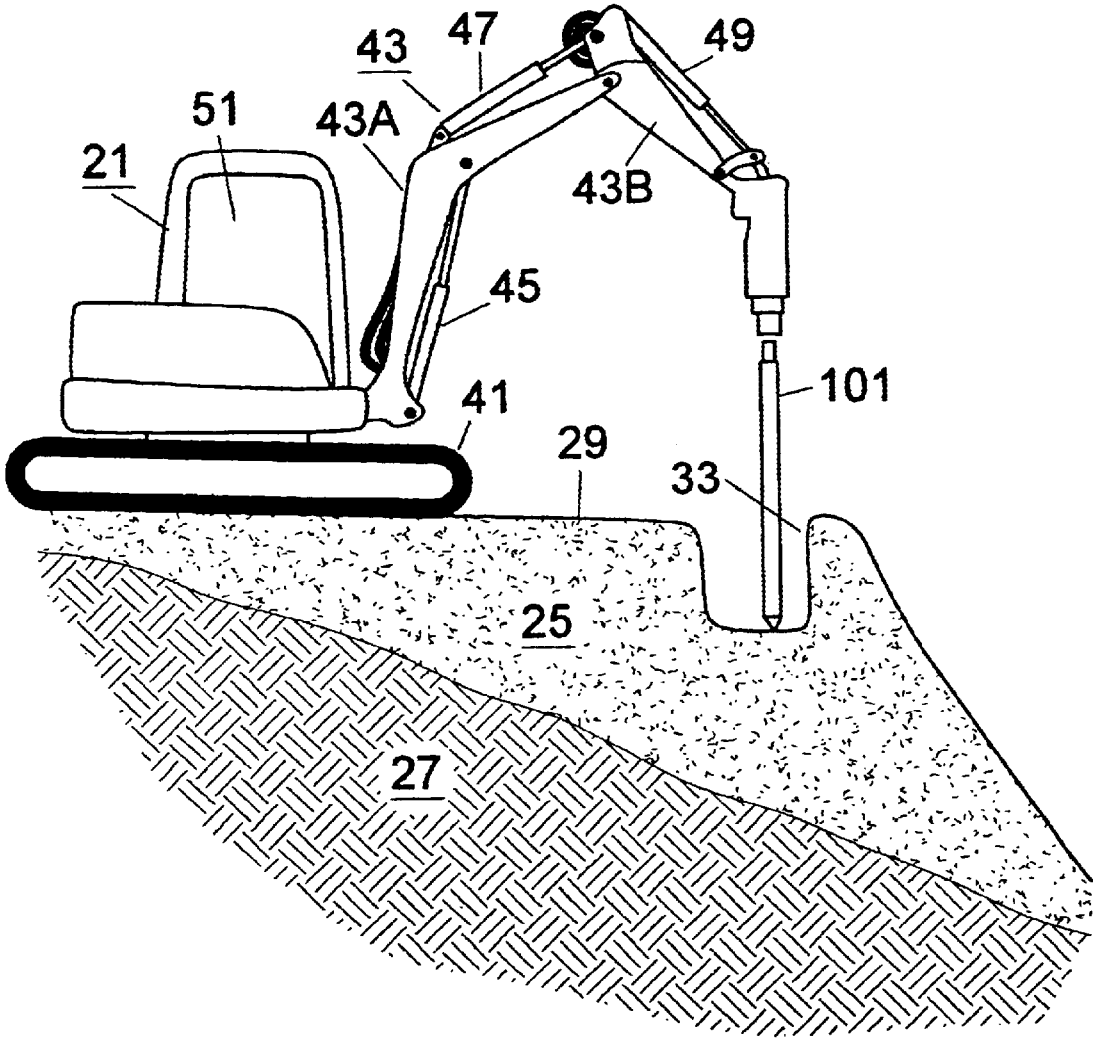
FIGS. 1 and 2 illustrate a tractor employed for in the process of installing a pilot in the ground for the alignment of the auger as well as a guide for the elongated members.

Referring now to the drawings, there is disclosed a conventional tractor 21 which may be used to carry out the process of installing the piling 23 (See FIG. 1) through non-compacted soil 25 and into a lower layer of compacted or undisturbed soil 27. The non-compacted soil 25 may have been scraped off of the hill formed by the soil 27 to form a horizontal surface 29 onto which a building is to be constructed. The upper end of the piling comprises a foundation support 31 which is shown located in a ditch or channel 33 in which the foundation of the building is to be formed. The foundation may comprises concrete poured in the ditch 33 around the support.

The piling 23 also may be used to provide support for the foundation of an existing building.

The tractor 21 is a conventional tractor available to the public in the U.S.A. and comprises a motor for driving the wheels of two endless belts 41 with threads for moving the tractor, a boom 43 comprising a pair of boom arms 43A pivotally coupled to the front of the tractor and a pair of boom arms 43B pivotally coupled to the outer ends of boom arms 43A. A hydraulic reservoir and pumps are employed to control hydraulic cylinders 45, 47, and 49 to move the arms of the boom to different positions. The controls are located in the cab 51 and are controlled by an operator (person).

A power unit 61 is coupled to the outer end of the boom 43. It has a tubular stem 63 which is employed to apply a downward vertical force to push the pilot tube 101 of the invention vertically into the ground when moved by the arms of the boom 43. The power unit 61 also is employed to rotate the auger of the invention to carry out the process of the invention.

Figure 10:
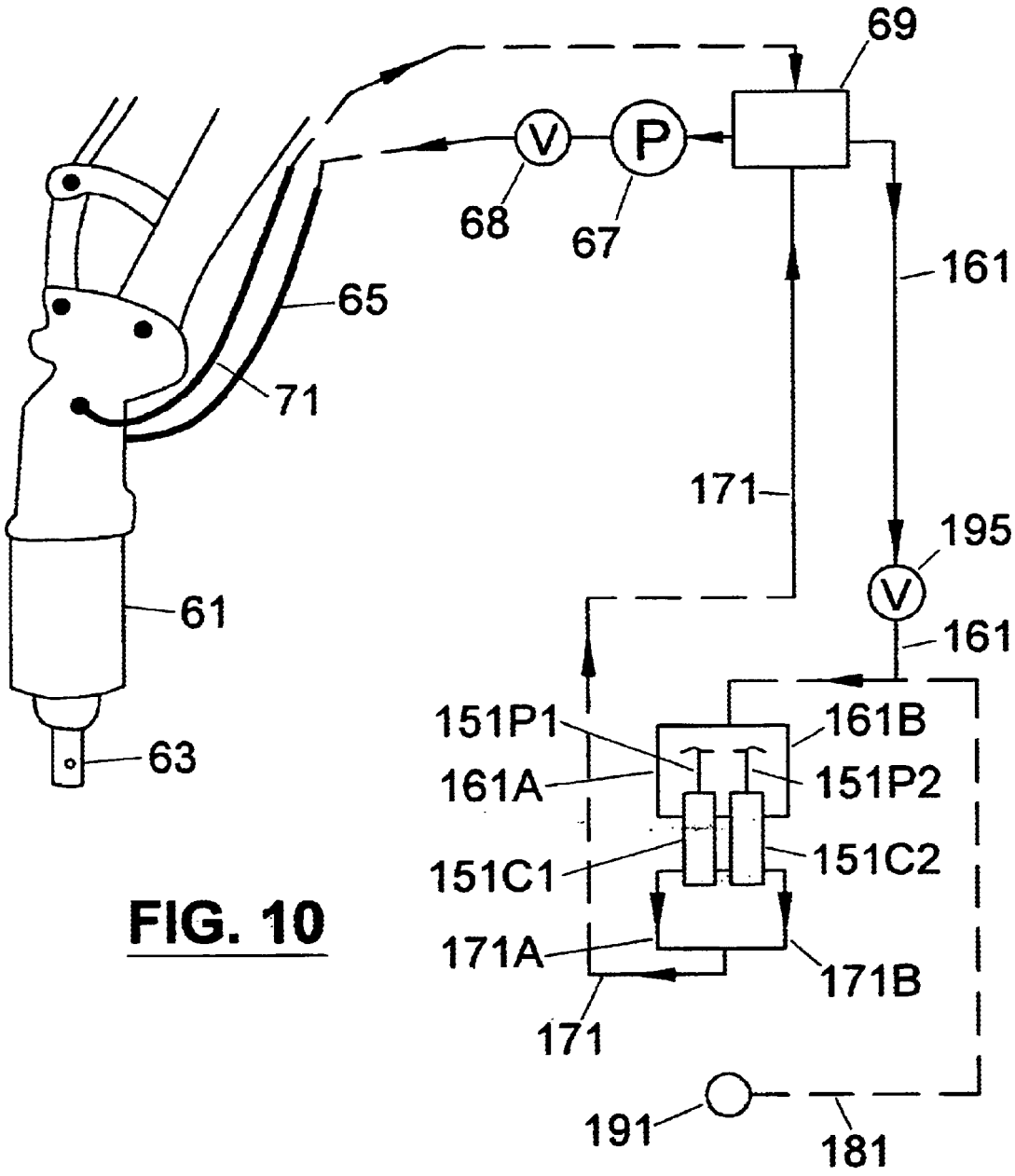
FIG. 10 is a schematic of the hydraulic system for rotating the power unit of the boom of the tractor and for operating the cylinders of FIGS. 5 and 6.
Figure 11:
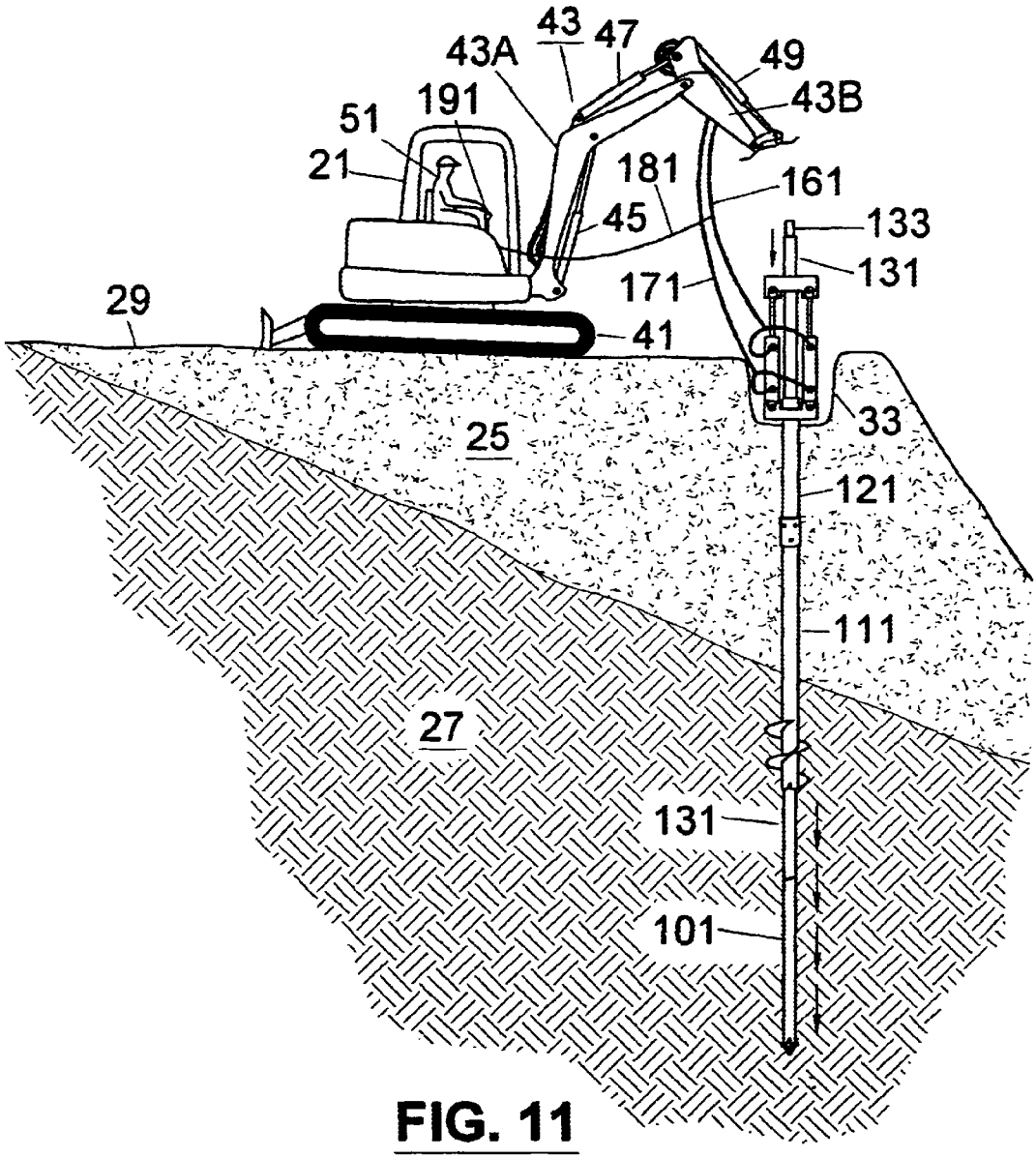
FIG. 11 illustrates driving of the pilot tube with auger moved to a fixed position in the earth below the non-compacted soil layer of FIG. 1.

The power unit 61 includes an internal impeller rotated by hydraulic fluid to rotate the tubular stem 63 having two aligned apertures 63A formed through its wall 180 degrees apart. As shown in FIG. 10, a hydraulic high pressure line 65 extends to the power unit from a pump 67 coupled to a hydraulic reservoir 69. A return line 71 extends from the power unit 61 back to the reservoir. When valve 68 is opened, hydraulic fluid is pumped from the reservoir 69 to the power unit 61 to rotate the impeller and hence the tubular stem 63.

The components that are used to form the piling 23 comprises the tubular iron pilot tube 101 having a pointed lower end 103 with a male catch 105 and a smaller diameter nipple 107 at its upper end. The nipple 107 is adapted to fit onto the tubular stem 63. Also provided is a metal auger 111 comprising a tubular stem 113 with a helical blade 115 attached to its lower end. Also formed in the wall of the stem 113 at the lower end is a notch 117 adapted to receive the catch 105. Formed through the stem 113 at its upper end are two aligned apertures 113A located 180 degrees apart. The upper end 113U is adapted to receive the stem 63 with apertures 113A aligned with apertures 63A for receiving a pin 119.

Figure 4:
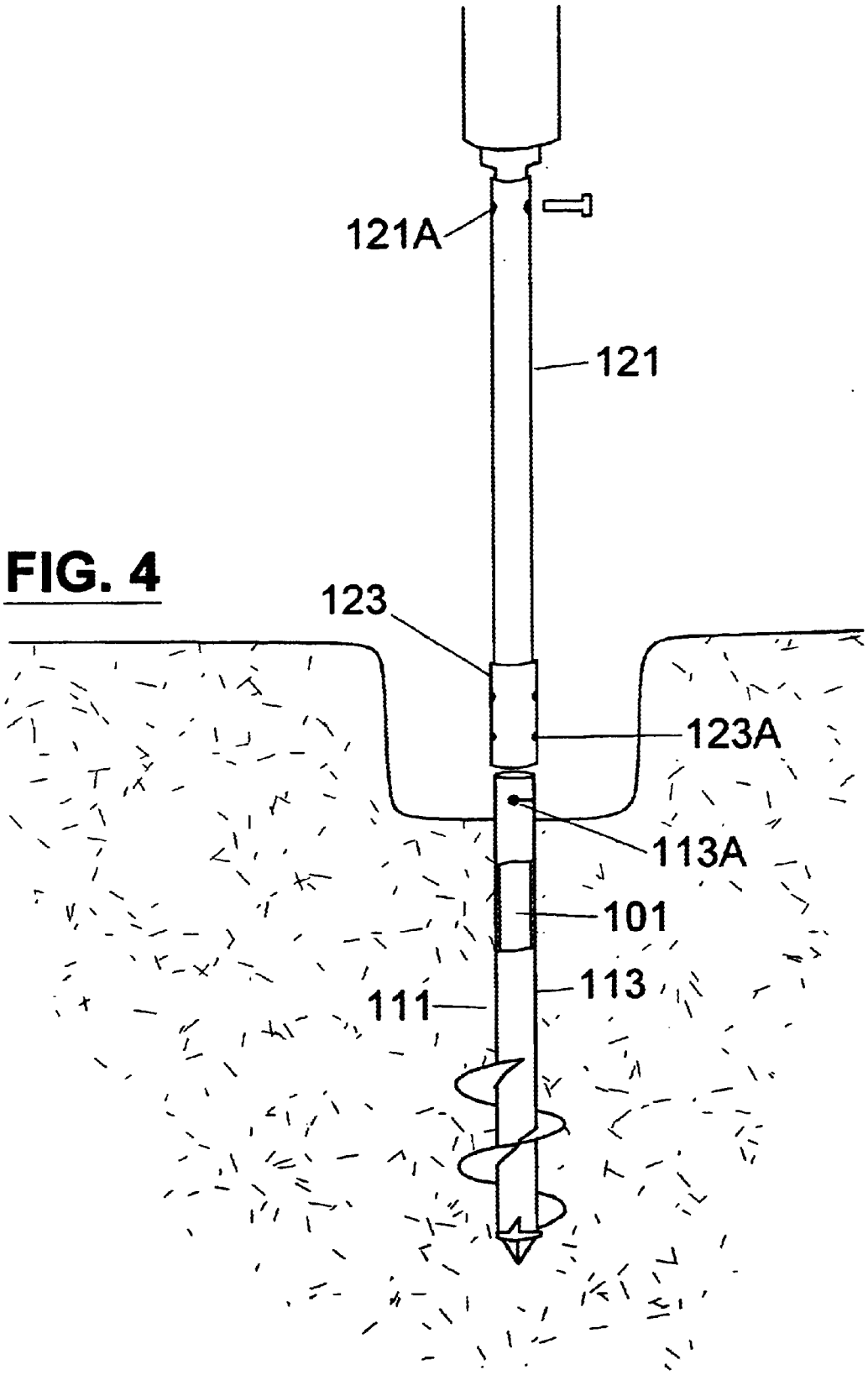
FIG. 4 illustrates an extension to be coupled to the stem of the auger.

A metal tubular extension stem 121 may be provided (FIG. 4). A lower sleeve 123 with apertures 123A is welded to the lower end of the stem 121 with a portion of the sleeve 123 extending below the lower end of the stem 121. The upper end of the stem 121 has apertures 121A formed therethrough 180 degrees apart. The upper end of the stem 121 may be fitted around the power unit stem 63 with the apertures 121A aligned with apertures 63A for receiving an attaching pin 119.

An upper metal tubular piling member 131 is provided (FIG. 5) and which may be slid into the upper end of the auger stem 113 or into the upper end of the extension auger stem 121 from its upper end. The upper end of the member 131 has a cylindrical nipple 133 welded thereto and has an outside diameter sufficient to be fitted into the lower end of another tubular piling member similar to member 131 in a stacking fashion.

In one embodiment, the pilot 101 tube may have a length of about 6 feet and the auger stem 111 and the piling member 131 each may have a length of about 10 feet.

In installing the piling 23, the pilot tube 101 has its pointed end 103 located on the ground which may be at the bottom of the ditch 33. The operator operates the controls of the tractor 21 to move the power unit 61 down to place the stem tube 63 around the nipple 107 of the tube 101. The operator then operates the hydraulic controls of the tractor 21 to cause the boom 43 and hence the power unit 61 to apply a vertical downward force to the nipple 107 to force the pilot tube 101 vertically into the ground about 5 feet leaving about 12 inches of the pilot above the bottom level of the ditch 33. The boom 43 then is moved upward to remove the power unit stem 63 from the pilot nipple 107. The upper end of the auger stem 113 then is fitted around the power unit stem 63 and secured to the stem 63 with a pin 119 by locating the pin 119 through the apertures 113A and 63A. The lower end of the auger stem 113 is located around the upper end of the pilot tube 101. The valve 68 is opened and the pump 67 is operated to rotate the auger 111 downward into the ground around the pilot 101 which acts as a guide to position the auger 111 vertically in the ground. The catch 105 of the pilot 101 and notch 117 of the auger stem 113 are formed such that when the auger stem 113 is rotated in the proper direction and is moving downward the catch 105 will be located in the notch 117 as shown in FIG. 4 and as the auger 113 continues to be rotated it will cause the pilot 101 to rotate also and to be moved further downward into the ground. Thus the auger 113 will be rotated downward around the pilot until the catch 105 is located in the notch 117, whereby the auger will rotate the pilot downward until the top of the auger is located near the bottom of the ditch 33 at which point the pump 67 is shut down to stop rotation of the stem 63 of the power unit 61.

If the auger 111 and the pilot 101 are not deep enough to the satisfaction of the operator, the stem 63 of the power unit 61 is detached from the auger stem 113 by removing the pin 119 and the sleeve 123 of the extension 121 is fitted around the upper end of the auger stem 113 and welded thereto around the bottom end of the sleeve 123 and through the apertures 123A. The upper end of the extension 121 is fitted around the stem 63 of the power unit and secured thereto with the pin 119 extending through the apertures 121 A and 63A. The pump 67 is operated again to rotate the stem 63 of the power unit 61 and hence the extension 121 to rotate the auger 111 deeper into the ground.

Figure 2:
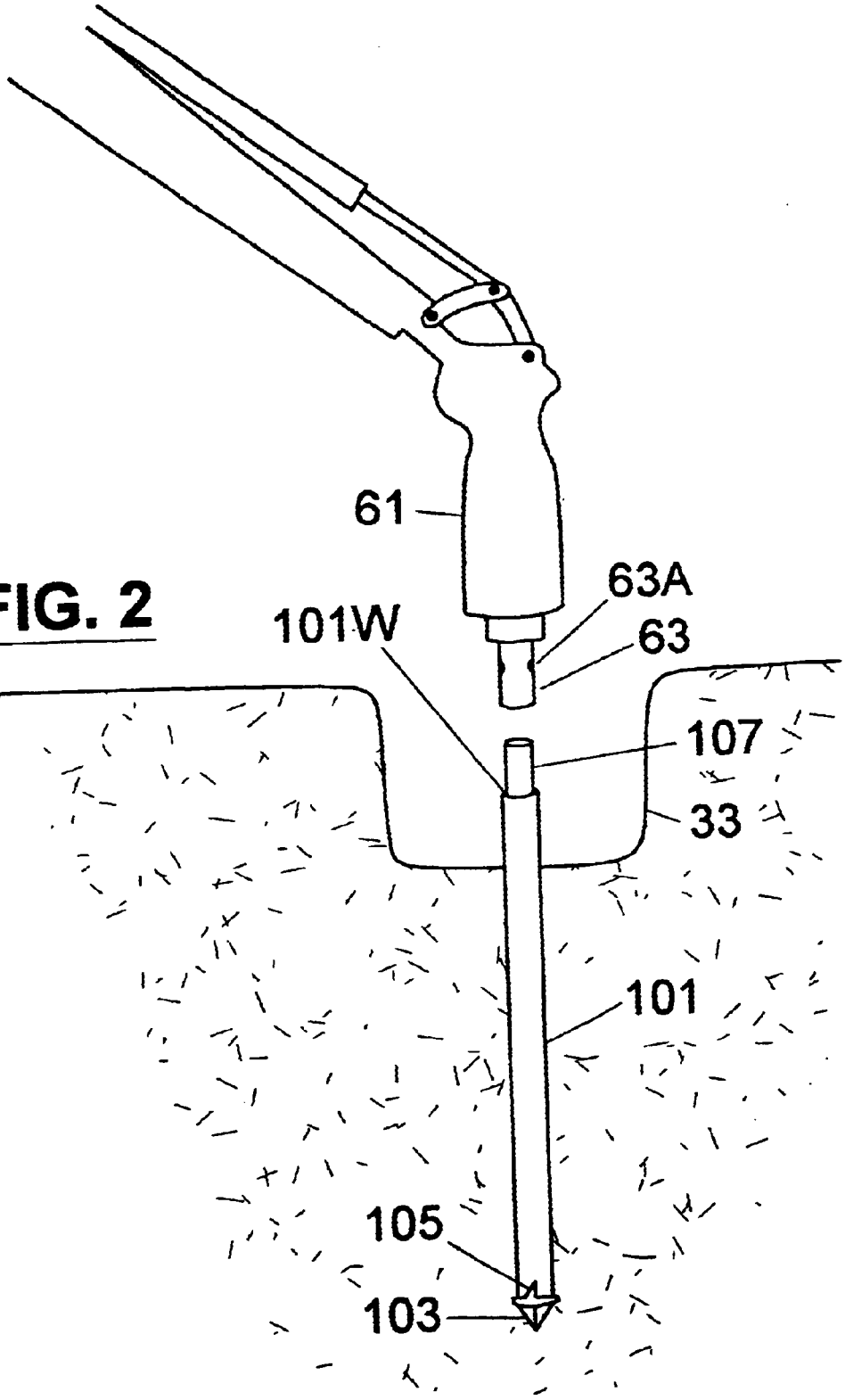
Figure 3:
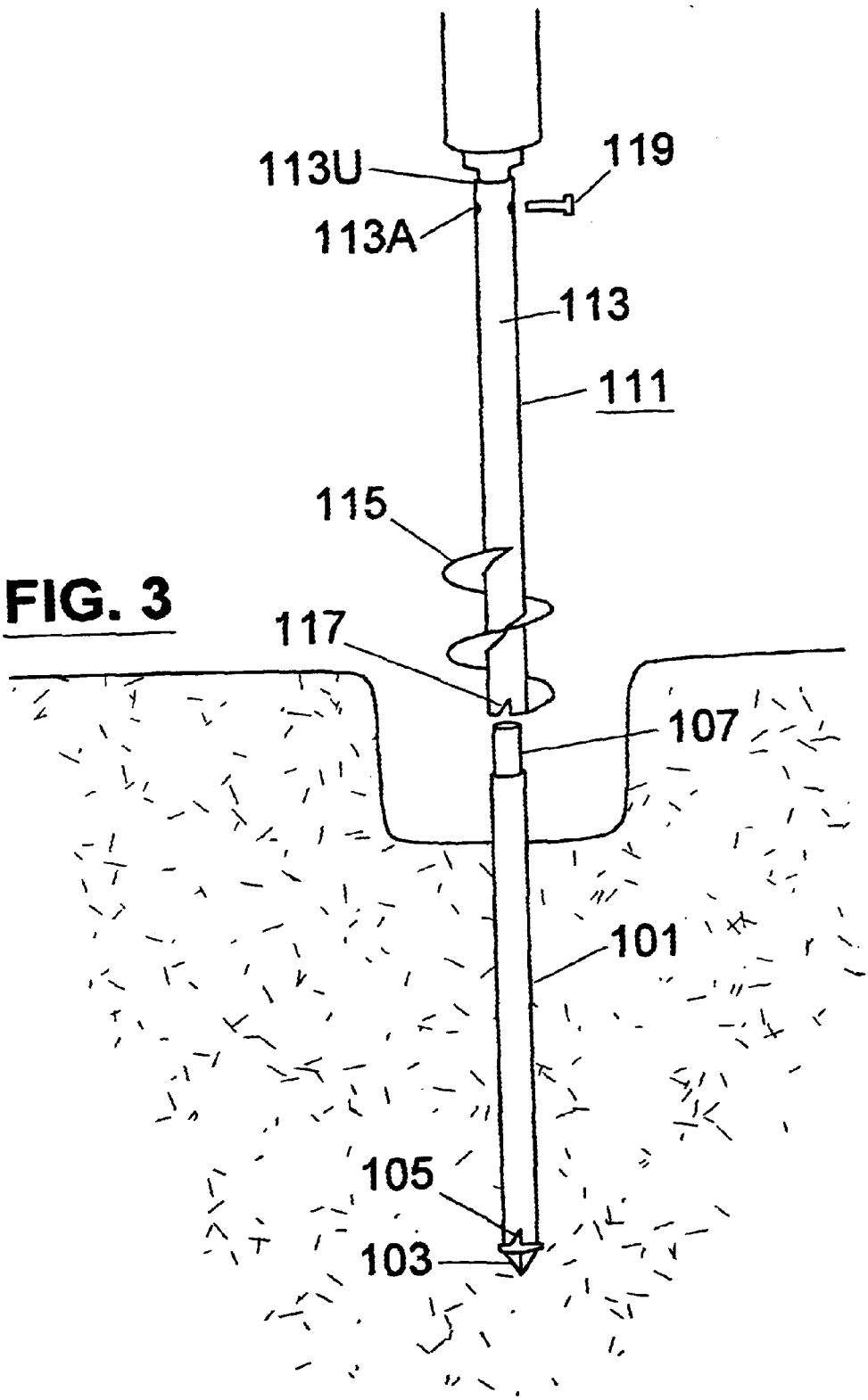
FIG. 3 illustrates the power unit of the tractor employed to screw an auger with its stem located around the installed pilot rod, into the earth.

A metal tubular piling 131 then has its lower end located in the upper end of the extension 121 and is moved downward until it is located around the nipple 107 of the pilot 101 and engages the upper wall 101W (See FIG. 2) of the tubular pilot member 101.

Two commercially available bowls and slips 151 and 153 are located around the extension 121 and the pile 131 respectively. The bowl 151 is pivotally coupled to two hydraulic cylinders 151C1 and 151C2 and their pistons 151P1 and 151P2 are pivotally coupled to the bowl 153. Hydraulic hoses 161A and 161B (coupled to hose 161) are coupled from one end of the cylinders 151C1, 151C2 to a high pressure side of a source of hydraulic fluid and hydraulic hoses 171A and 171B (coupled to hose 171) are coupled from the other ends of the cylinders 151C1, 151C2 to the return side of the source of hydraulic fluid. A valve 195 is coupled from the reservoir 69 for controlling hydraulic fluid flow through the hose 161. The pump 67 and reservoir 69 are permanent parts of the tractor. An extension hose 181 is coupled to the high pressure hose 161 which extends to the cab of the tractor 21 where it is coupled to a pressure meter 191. When the pump 67 is operated and the valve 195 is opened, the pump forces hydraulic fluid into the upper ends of the cylinders 151C1 and 151C2 the pistons l51P1 and 151P2 are forced downward. The bowls 151 and 153 bite into the extension 121 and piling 131 respectively such that an upward force is applied to the extension 121 and auger 111 and a downward force is applied to the piling 131. This forces the piling 131 and hence the pilot tube 101 further downward into the earth until a desired amount of resistance or pressure is achieved as reflected by the meter 191. Thus the auger 111 acts as an anchor in moving the piling 131, 101 downward into the earth until a desired amount of resistance is achieved.

The bowls 151 and 153, cylinders 151C1, 151C2, and pistons 151P1, 515P2 and hoses 161, 161A, 161B, 171, 171A, 171B are then removed.

This will leave the extension 121 extending above the ground about 6 inches with the piling 131 extending above the top of the extension 121. The piling 121 will be cut off such that it extends about 4 inches above the top of the extension 121 and then members 121 and 131 will be welded together. A metal U-shape piling cap 31 with a metal sleeve 201 secured to its bottom side will be employed by sliding the sleeve 201 over the top of the piling member 131 and welding the cap 31 to the member 131. Members 203 are metal piling cap rings through which metal rebar 205 are inserted. A number of the pilings 23 with their caps 31 may be employed at the construction site with the rebar 205 coupled to each of the caps and then concrete poured in the ditch 33 to form a foundation for the structure to be built or repaired. The number of pilings 23 employed will depend on the weights and measures of the structure to be built or repaired.

Figure 5:
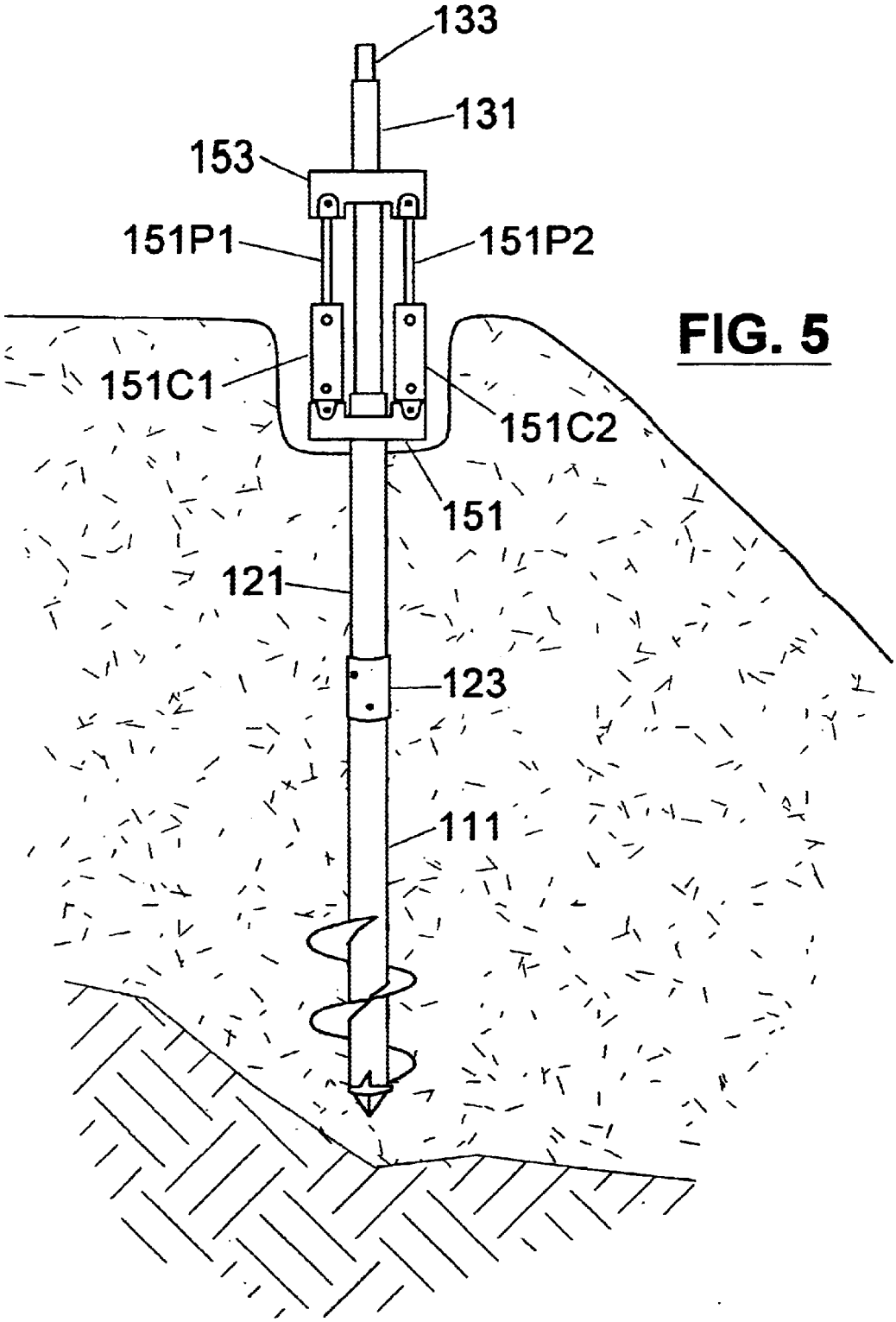
FIG. 5 illustrates two bowl and slips coupled to the extension and a piling member with hydraulic cylinders and pistons coupled to the two bowl and slips respectively.
Figure 6:
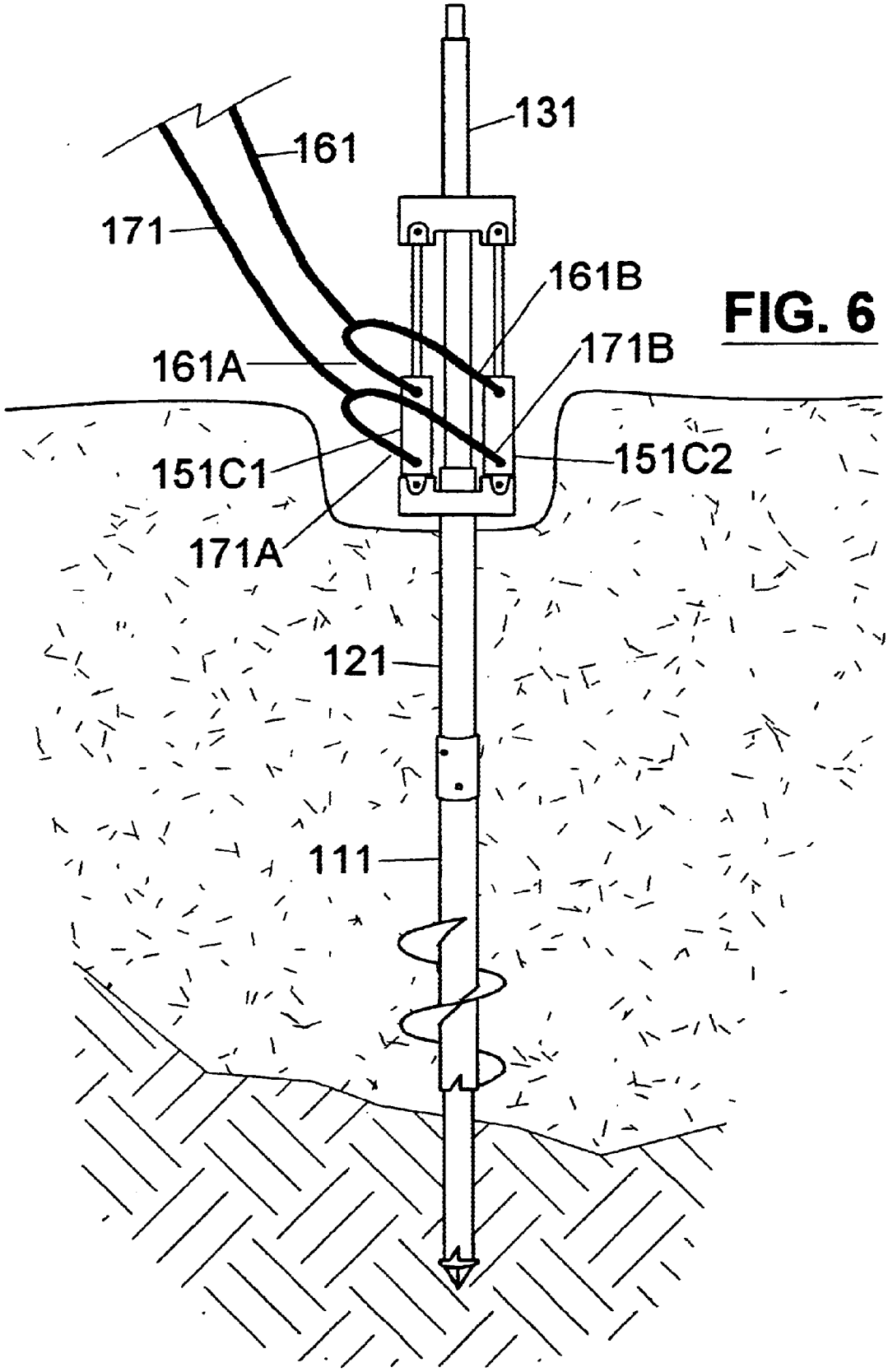
FIG. 6 illustrates more detail of the hydraulic system of FIG. 5.
Figure 7:
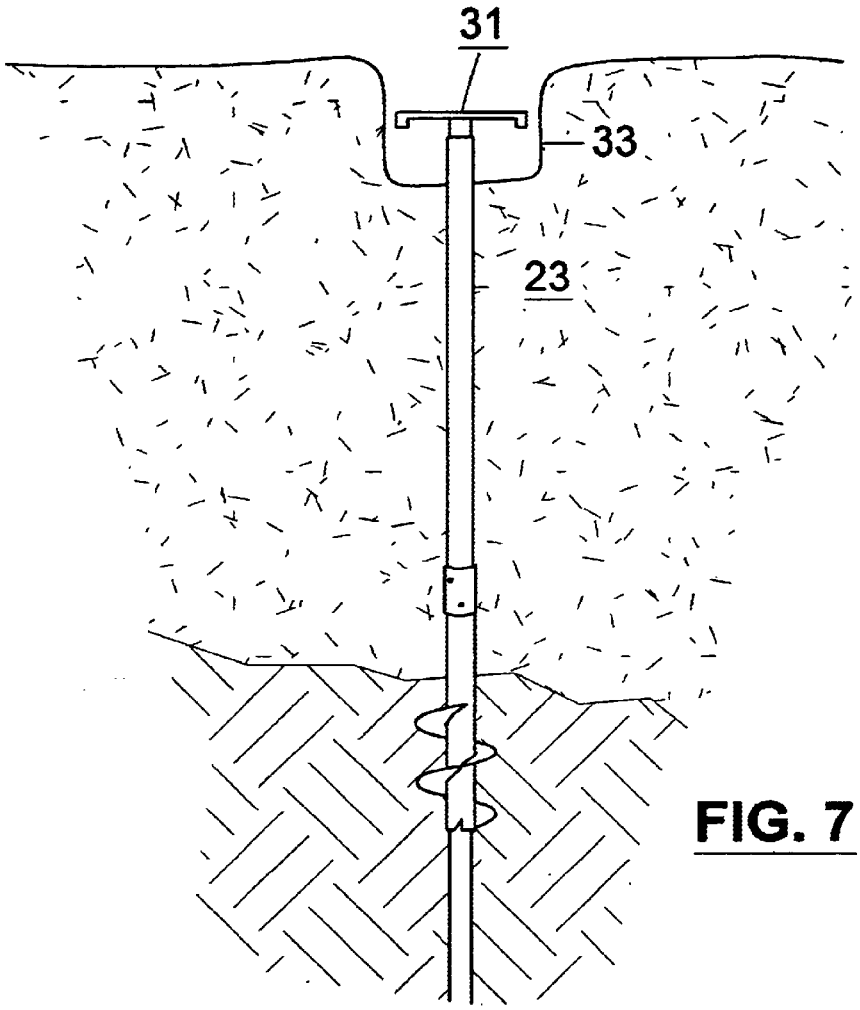
FIG. 7 illustrates a piling cap attached to the driven upper piling rod.
Figure 8:
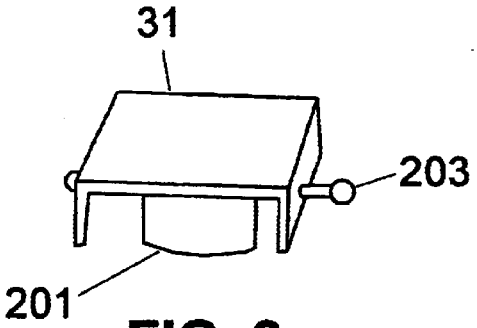
FIG. 8 shows more detail of the piling cap.
Figure 9:
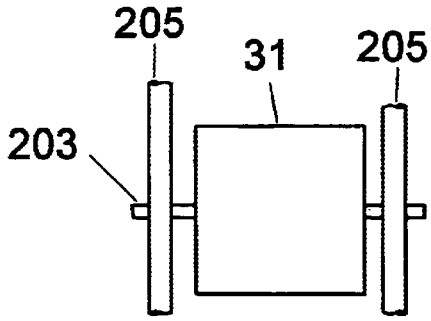
FIG. 9 is a top view of the piling cap of FIG. 8.

If the extension 121 is not needed, the hydraulic system of FIGS. 5 and 6 will be coupled to the auger stem 111 to push the piling 131 and pilot tube 101 downward into the ground and the upper end of the piling 131 will be cut off above the stem 111 and welded to the stem 111 and the cap 31 welded to the piling 131 for supporting the rebar.

Reference is made to U.S. Pat. Nos. 4,117,944, 4,365,428, and for disclosures of a backhoes which employ booms similar to the tractor 21 of FIG. 1. These patents are incorporated into this ion by reference.

In one embodiment, the pilot tube 101 may have an outside diameter of 2⅞ inches; the auger stem 113 may have an outside diameter of 3½ inches; the extension tube 121 may have an outside diameter of 3½ inches; and the piling tube 131 may have an outside diameter of 2⅞ inches. The dimensions, however may vary.

It is to be understood that the pilot tube can be pushed into the and the auger may be rotated into the ground by equipment different than that of the tractor 21 and boom 43 as described above.

What is claimed is:

1. A process of securing a foundation support of a building to the ground using at least first and second elongated members each having first and second ends and an auger comprising a tubular member, comprising the steps of:

inserting into the ground said first elongated member by forcing said first end of said first elongated member downward into the ground, locating said tubular member of said auger around said second end of said first elongated member and rotating said tubular member of said auger to move said tubular member of said auger downward around said first elongated member, inserting said first end of said second elongated member into said tubular member to engage said second end of said first elongated member, applying an upward force to said tubular member of said auger which applying a downward force to said second elongated member to force said first and second elongated members downward into the ground until a desired amount of resistance is achieved, attaching said second elongated member to said tubular member to form a ground support, and coupling said foundation support to said ground support.

2. The process of claim 1, wherein:

said upward and downward forces are applied to said tubular member and to said second elongated member by coupling a hydraulic piston and cylinder between said tubular member and said second elongated member and applying hydraulic force to said cylinder to move said piston outward from said cylinder.

3. The process of claim 2, wherein:

hydraulic fluid is applied by way of a tubular member to said cylinder to move said piston outward from said cylinder to apply said downward force to said second elongated member, measuring the pressure of hydraulic fluid in said tubular member to determine said desired amount of resistance.

4. The process of claim 1, wherein:

said auger is rotated downward around said first elongated member until a means at said second end of said first elongated member is engaged by said second end of said tubular member and then rotating said tubular member further to move said tubular member and said first elongated member further downward in the ground.

5. The process of claim 4, wherein:

said upward and downward forces are applied to said tubular member and to said second elongated member by coupling a hydraulic piston and cylinder between said tubular member and said second elongated member and applying hydraulic force to said cylinder to move said piston outward from said cylinder.

6. The process of claim 5, wherein:

hydraulic fluid is applied by way of a tubular member to said cylinder to move said piston outward from said cylinder to apply said downward force to said second elongated member, measuring the pressure of hydraulic fluid in said tubular member to determine said desired amount of resistance.

7. A process of securing the foundation of a building to the ground using at least first and second elongated member each having first and second ends and an auger comprising a tubular member and an auger extension comprising a tubular member, comprising the steps of:

inserting into the ground said first elongated member by forcing said first elongated member downward into the ground, locating said tubular member of said auger around said second end of said first elongated member and rotating said tubular member of said auger to move said tubular member of said auger downward into the ground around said first elongated member and then to move said first elongated member further downward into the ground, attaching said tubular member of said auger extension to the upper end of said tubular member of said auger, rotating said tubular member of said auger extension and hence said tubular member of said auger to move said tubular member of said auger downward around said first elongated member, inserting said first end of said second elongated member into said first tubular members to engage said second end of said first elongated member, applying an upward force to said tubular member of said auger extension while applying a downward force to said second elongated member to force said first elongated member downward into the ground.

8. A support structure for a foundation comprising:

an elongated pilot member inserted into the ground, an auger comprising a tube inserted into the ground and surrounding the upper position of said pilot member, said tube having an upper portion extending above the ground, a piling member having a lower end located in said tube and engaging said pilot member and an upper end extending above the ground and above said upper portion of said tube, said upper portion of said tube and said upper end of said piling member being connected together, and a foundation support connected to said upper end of said piling member.

* * * * *